US006840598B2

(12) United States Patent
Fairchild et al.

(10) Patent No.: US 6,840,598 B2
(45) Date of Patent: Jan. 11, 2005

(54) AUTOMATIC PRINTHEAD-TO-MEDIA SPACING ADJUSTMENT SYSTEM

(75) Inventors: Michael A. Fairchild, Vancouver, WA (US); Allan D. Donley, Ettlingen (DE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/649,564

(22) Filed: Aug. 26, 2003

(65) Prior Publication Data

US 2004/0056911 A1 Mar. 25, 2004

Related U.S. Application Data

(63) Continuation of application No. 10/213,494, filed on Aug. 6, 2002, now Pat. No. 6,672,696, which is a continuation of application No. 09/773,392, filed on Jan. 31, 2001, now abandoned.

(51) Int. Cl.[7] ..... B41J 25/308
(52) U.S. Cl. ..... 347/37; 400/59
(58) Field of Search ..... 347/8, 37; 400/55, 400/59, 355; 74/813 R, 813 L

(56) References Cited

U.S. PATENT DOCUMENTS 3,817,365 A * 6/1974 Zimmermann ..... 400/59
4,277,189 A * 7/1981 Howard et al. ..... 400/320
4,657,415 A * 4/1987 Kikuchi et al. ..... 400/59
5,000,590 A * 3/1991 Einem ..... 400/55
5,880,757 A * 3/1999 Ta ..... 347/40
6,027,264 A * 2/2000 Maher et al. ..... 400/55
6,042,217 A * 3/2000 Jones ..... 347/32
6,543,868 B2 * 4/2003 Cooper et al. ..... 347/8
6,672,696 B2 * 1/2004 Fairchild et al. ..... 347/8

* cited by examiner

*Primary Examiner*—Lamson Nguyen
*Assistant Examiner*—Blaise Mouttet

(57) ABSTRACT

An inkjet printer service station has a movable member that interacts with another printer subsystem, which is changeable between a first state and a second state. To vary the printhead-to-media spacing to accommodate different thickness of media, such as plain paper and envelopes, a cam-operated locking mechanism and a lever-operated mechanism raise and lower the inkjet printhead. Other printer subsystems may be transitioned between two or more states through motion of a service station movable member, including motion using gravity assist, centrifugal forces, or momentum to accomplish one of the transitions. Other locking mechanisms may be used to secure a subsystem in one state or another, such as electrical or electromechanical mechanisms, as well as other structurally equivalent forms beyond the specific preferred embodiments illustrated herein without departing from the broad concepts disclosed. An inkjet printing mechanism having such a system, along with methods of operation are also provided.

20 Claims, 9 Drawing Sheets

AUTOMATIC PRINTHEAD-TO-MEDIA SPACING ADJUSTMENT SYSTEM

This is a continuation of application number 10/213,494, filed Aug. 6, 2002, Now U.S. Pat. No. 6,672,696 which is a continuation of application number 09/773,392, filed Jan. 31, 2001, now abandoned.

The present invention relates generally to hardcopy mechanisms, and more particularly to a subsystem of a hardcopy mechanism which changes state in response to movement of a service station member, and in the illustrated hardcopy printing mechanism embodiment, to a subsystem which adjusts printhead-to-media spacing in a printzone to accommodate different media (e.g. paper) thicknesses in response to movement of the service station member to provide high quality images on varying thickness of media.

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. While earlier, more primitive servicing mechanisms were operated in response to printhead movement, the newer more advanced servicing mechanisms often employ a separate service station motor which operates to move the servicing members between their rest and servicing positions.

As a preliminary matter, there is a term of art used by inventors skilled in this art that will speed the reading if used herein, and it is "pen-to-paper spacing," often abbreviated as "PPS" or "PPS spacing." In the English language of the inventor, "pen-to-paper spacing" or "PPS" is easier to pronounce than the more technically explicit term "media-to-printhead spacing," and for this reason the terms "PPS" or "pen-to-paper spacing" are used herein. During prototype testing and development, inventors use vast amounts of media, so the most plentiful and economical media, plain paper is used. Indeed, the short-hand term "pen-to-paper spacing" is a logical selection of terminology, although it must be understood that as used herein, this term encompasses all different types of media, unless specified otherwise in describing a particular type of media. Thus, "pen-to-paper spacing" (PPS) defines the spacing between the inkjet cartridge printhead and the printing surface of the media, which may be any type of media, such as plain paper, specialty paper, card-stock, fabric, transparencies, foils, mylar, etc.

Having dispensed with preliminary matters, the discussion of the problems encountered in this art in maintaining an accurate PPS now continues. For instance, there are variations in the thickness of the print media which affect the PPS spacing. For example, envelopes, poster board and fabric are typically thicker than plain paper or a transparency. Thicker media decreases the spacing from the printhead to the printing surface, and in the worst case, this reduced spacing could lead to contact of the printhead with the media, known as a "printhead crash," possibly damaging either the printhead or the image.

The earliest printing mechanisms used a constant printhead-to-media spacing, ignoring the media thickness and sacrificing print quality when thicker medias, such as envelopes or other media thicker than plain paper were printed upon. Unfortunately, one danger in ignoring printhead to paper spacing was the potential for suffering a printhead crash. To prevent printhead crashes, and subsequent printhead damage, as well as potentially ruining the print job, one prior solution provided a "user-switch" for adjusting PPS spacing. These user operable PPS adjustments required users to turn a knob, or push a lever to increase the PPS for better print quality when printing on thicker media. Unfortunately, in these user switchable systems, most users either never understood the switch, or never knew the switch existed, and if they did, they rarely if ever used it, so they continually obtained disappointing outputs when switching between different thicknesses of media. Furthermore, even if consumers were aware of the user switchable PPS adjustment feature, and they did use it, the switch still requires an extra user intervention step in the printing process, which would be desirable to eliminate to provide a more user-friendly product.

Normally to improve printing speed, known as "throughput" measured in pages per minute, print quality is unfortunately sacrificed. Tests have shown that faster print speeds may be obtained, along with higher print quality, if the PPS spacing is reduced. One of the main stopping blocks to reducing PPS spacing lower than current levels is that envelopes, as well as other thicker print media, do not feed well through a nominal plain paper PPS spacing without smearing against the printheads. Thus, it would be desirable to have an automatic way to switch between two different printhead to platen separations, a large one for thicker media and small one for regular plain paper media, as well as transparencies, premium papers, and photo media.

Indeed, it would be desirable to provide more than two different PPS spacings to accommodate different types of specialty media. For example, plain papers often swell during printing as they soak up the liquid from the ink composition, a problem in the art often referred to as "cockle" where the media actually begins to buckle. Thus, for printing on plain papers the PPS spacing must be larger to avoid printhead crashes into upwardly bowed portions of the paper. In contrast, when printing upon various premium and photo medias, including transparencies, typically very little ink is absorbed into the media, so cockle is not a problem, allowing closer PPS spacings to be used. Closer PPS spacings are typically associated with yielding higher print quality, so in printing upon these specialty medias which are immune to cockle, it would be desirable to have a closer PPS spacing than when printing on plain paper. Indeed, as the various types of print media change, with different swelling characteristics and thicknesses, a variety of different spacings between the media support platen and the printhead may be desirable to accommodate these varying different thicknesses and cockle characteristics. Furthermore, as mentioned above it would be desirable to have this adjustment be accomplished without user intervention to provide a more robust, and easier to use printing mechanism, which continuously provides high print quality on a variety of different types of media.

One earlier media handling system tried to accommodate thicker envelopes, using a width sensor that detected media narrower than about 12 cm (4.5 in). Upon detecting this narrow media, a mechanical arm opened an inlet port on the media handling system to a much wider gap than normal to prevent ink smear on the envelope. Other earlier media handling systems lacked any ability to adjust the PPS spacing, other than adjustments made during initial assembly at the factory. One on-the-fly PPS adjustment system is disclosed in U.S. Pat. Nos. 5,838,338 and 6,102,509, currently assigned to the present assignee, the Hewlett-Packard Company. In this on-the-fly PPS adjustment system, the platen supporting the undersurface of the media in the printzone was lowered or raised to accommodate thicker or thinner media, respectively.

Given the ability of pen-to-paper spacing to affect print quality, one goal herein is to automatically adjust the PPS spacing to accommodate different thicknesses of media to maintain high print quality on all media thickness.

A broader goal herein is to provide a hardcopy mechanism with a subsystem which changes state in response to movement of a service station member.

SUMMARY OF THE INVENTION

According to one aspect, a method of operating on a hardcopy media with a hardcopy mechanism having a subsystem and a service station with a moveable member includes feeding the media to the hardcopy mechanism. The method also includes adjusting the subsystem from a first state to a second state using the moveable member. Finally thereafter, the method includes performing an operation on the media using the subsystem.

According to another aspect, a hardcopy mechanism is provided as including a subsystem which operates on hardcopy media in a first state or a second state. The hardcopy mechanism also includes a service station having a moveable member which cooperates with the subsystem to change from the first state to the second state.

According to a further aspect, a hardcopy printing mechanism for printing an image on media includes a media handling system which delivers media to a printzone, and a printhead which prints the image on the media when in the printzone. The printing mechanism also has a service station with a moveable member. The media handling system, the printhead, and the media when in the printzone, establish a spacing between the media and the printhead. The printing mechanism also has an adjustment member which adjusts the spacing in response to movement of the moveable member.

According to an additional aspect, a subsystem of a hardcopy mechanism, which has a service station with a moveable member, includes an activation member. The activation member adjusts the subsystem from a first state to a second state in response to motion of the moveable member. The subsystem also includes a locking mechanism which secures the subsystem in either the first state or the second state.

According to yet another aspect, a hardcopy mechanism includes a first subsystem which operates on hardcopy media in a first state or a second state. The hardcopy mechanism also has a service station with a moveable member which cooperates with the first subsystem to change between the first state and the second state.

According to an additional aspect, a hardcopy printing mechanism is provided for printing an image on media. The hardcopy mechanism has a media handling system which delivers the media to a printzone. A printhead prints the image on the media when in the printzone. The hardcopy mechanism has a service station with a moveable member. The media handling system, the printhead, and the media when in the printzone, establish a spacing between the media and the printhead. The hardcopy mechanism also has an adjustment member which adjusts the spacing in response to movement of the moveable member.

An overall goal herein is to provide a hardcopy mechanism, and a subsystem therefore, which changes state in response to movement of a service station member, and a method therefore.

A more specific goal herein is to provide a subsystem for the illustrated hardcopy printing mechanism embodiment which adjusts printhead-to-media spacing in a printzone to accommodate different media thicknesses in response to movement of a service station member to provide high quality images on varying thickness of media, and a method therefore, along with a hardcopy printing mechanism having such a subsystem.

BRIEF DESCRIPTION OF THE DRAWINGS

FIGS. 4–7 are top plan views of the first embodiment of the spacing system of FIG. 3, shown in various operating positions, specifically with:

FIG. 4 showing a default, lowered printhead position for accommodating thin media;

FIG. 5 showing a transition between the default position of FIG. 4 and an elevated printhead position for accommodating thicker media;

FIG. 6 showing an elevated printhead position for accommodating thick media; and FIG. 7 showing the elevated printhead position of FIG. 6, as the carriage moves the printheads into a printing position.

FIGS. 9–12 are enlarged, fragmented top plan views of the PPS adjustment system of FIG. 8, specifically with:

FIG. 9 showing a default lowered printhead position for accommodating thin media;

FIG. 10 showing a transition between the selected default position of FIG. 9 and an elevated printhead position for accommodating thicker media;

FIG. 11 showing the elevated printhead position for accommodating thick; and FIG. 12 showing a resetting operation which lowers the printhead from the elevated position back to the default position of FIG. 9.

FIGS. 13–15 are enlarged, fragmented, top plan views of the adjustment lever of FIGS. 8–12, specifically with:

FIG. 13 showing the lowered printhead position for accommodating thin media;

FIG. 14 showing the elevated position for accommodating thick media; and

FIG. 15 showing the resetting operation where the printhead is returned from the elevated state to the lower default state.

DETAILED DESCRIPTION OF THE PREFERRED EMBODIMENTS

Figure 1:
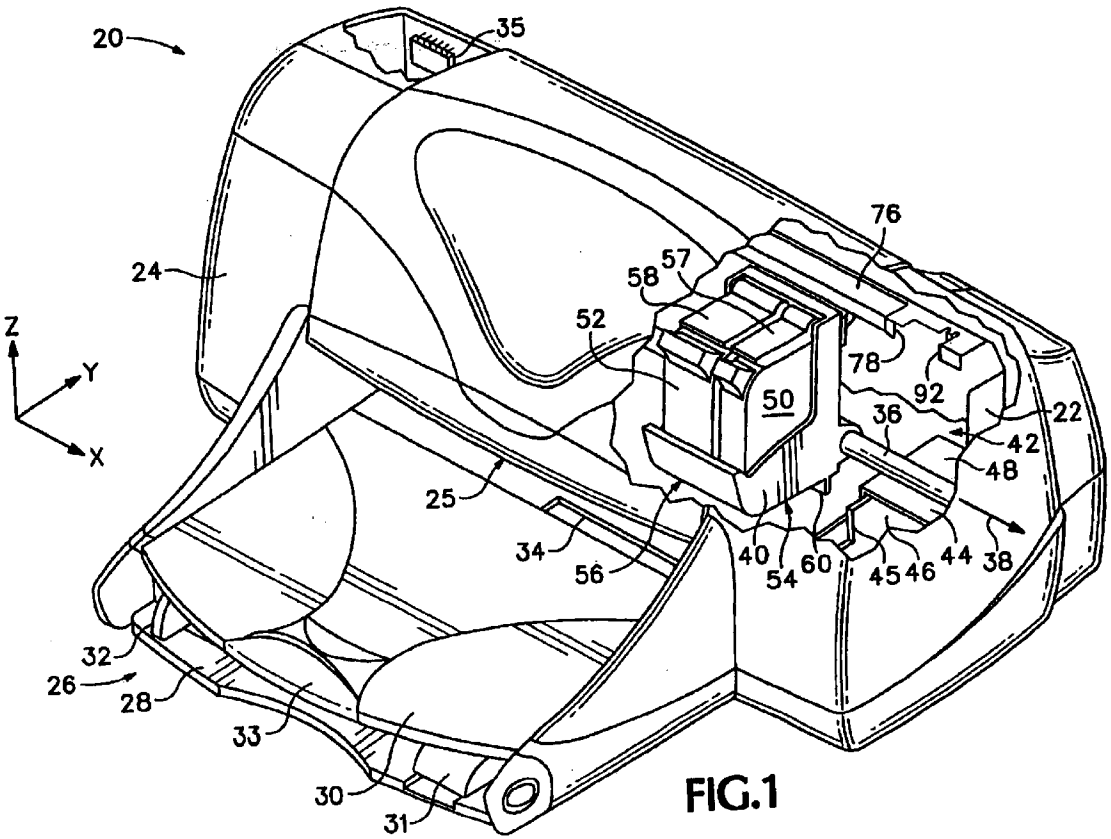
FIG. 1 is a perspective view of one form of a hardcopy printing mechanism, here shown as an inkjet printer, having an automatic printhead-to-media spacing system.

FIG. 1 illustrates an embodiment of a hardcopy mechanism, here shown as an inkjet printer 20, constructed in accordance with the present invention, which may be used for printing for business reports, correspondence, envelopes, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts introduced herein are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print handling system 26, constructed in accordance with the present invention. The print media may be any type of suitable sheet material, such as paper, card-stock, transparencies, mylar, and the like, but for convenience, the illustrated embodiment is described using paper sheets or paper envelopes as the print medium. The print media handling system 26 has a supply or feed tray 28 for storing sheets of paper before printing. A series of conventional motor-driven paper drive rollers may be used to move the print media from tray 28 into the printzone 25 for printing. After printing, the sheet then exits into an output tray portion 30 where it is easily removed by a user. The media handling system 26 may include a series of adjustment mechanisms for accommodating different sizes of print media, including letter, legal, A-4, envelopes, etc., such as a sliding input length adjustment lever 31, a sliding input width adjustment member 32, a sliding output length adjustment member 33, and an envelope feed slot 34.

The printer 20 also has a printer controller, illustrated schematically as a microprocessor 35; that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the hardcopy mechanism, an intermediary device therebetween, or by a combined interaction of such elements. The printer controller 35 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 36, supported by the chassis 22, defines a scanning axis 38, and slideably supports an inkjet carriage 40 for travel back and forth across the printzone 25 along the scanning axis 38. One suitable type of carriage support system is shown in U.S. Pat. No. 5,366,305, assigned to Hewlett-Packard Company, the assignee of the present invention. A conventional carriage propulsion system may be used to drive carriage 40, including a conventional position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

The carriage 40 is also propelled along the guide rod 36 into a servicing region, as indicated generally by arrow 42, located within the interior of casing 24. The servicing region 42 houses a service station 44 which includes a moveable activation member 45 extending upwardly from a moveable platform, such as a translationally moveable pallet 46. The pallet is housed within a service station frame 48, which is supported by the chassis 22. The pallet 46 may be used to support various conventional printhead servicing components, such as caps, wipers, primers and the like (omitted for clarity), for instance as shown in U.S. Pat. Nos. 5,617,124 and 5,082,848 currently assigned to the Hewlett-Packard Company, the present assignee. Furthermore, while the activation member 45 is shown mounted to a translating (sliding) pallet 46, this is only by way of illustration, and other service station designs may be used to implement the principles disclosed herein, such as rotary service stations having rotating platforms, or those having platforms equipped for both rotary and translational motion.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as paraffin based inks, as well as hybrid or composite inks having both dye and pigment characteristics.

The illustrated pens 50, 52 each include reservoirs for storing a supply of ink. The pens 50, 52 have printheads 54, 56 respectively. The carriage 40 has a pair of latches 57 and 58, which press each pen 50, 52 against alignment datums inside the carriage to align printheads 54, 56 at desired positions. Each printhead 54, 56 has an orifice plate with a plurality of nozzles formed in a manner well known to those skilled in the art and arranged in linear arrays. The term "linear" as used herein may be interpreted as "nearly linear" or substantially linear, and may include nozzle arrangements slightly offset from one another, for example, in a zigzag arrangement. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multiconductor strip (not shown) from the controller 35 to the printhead carriage 40, and through conventional interconnects between the carriage and pens 50, 52 to the printheads 54, 56.

Automatic Printhead-to-Media Spacing Adjustment System

Figure 2:
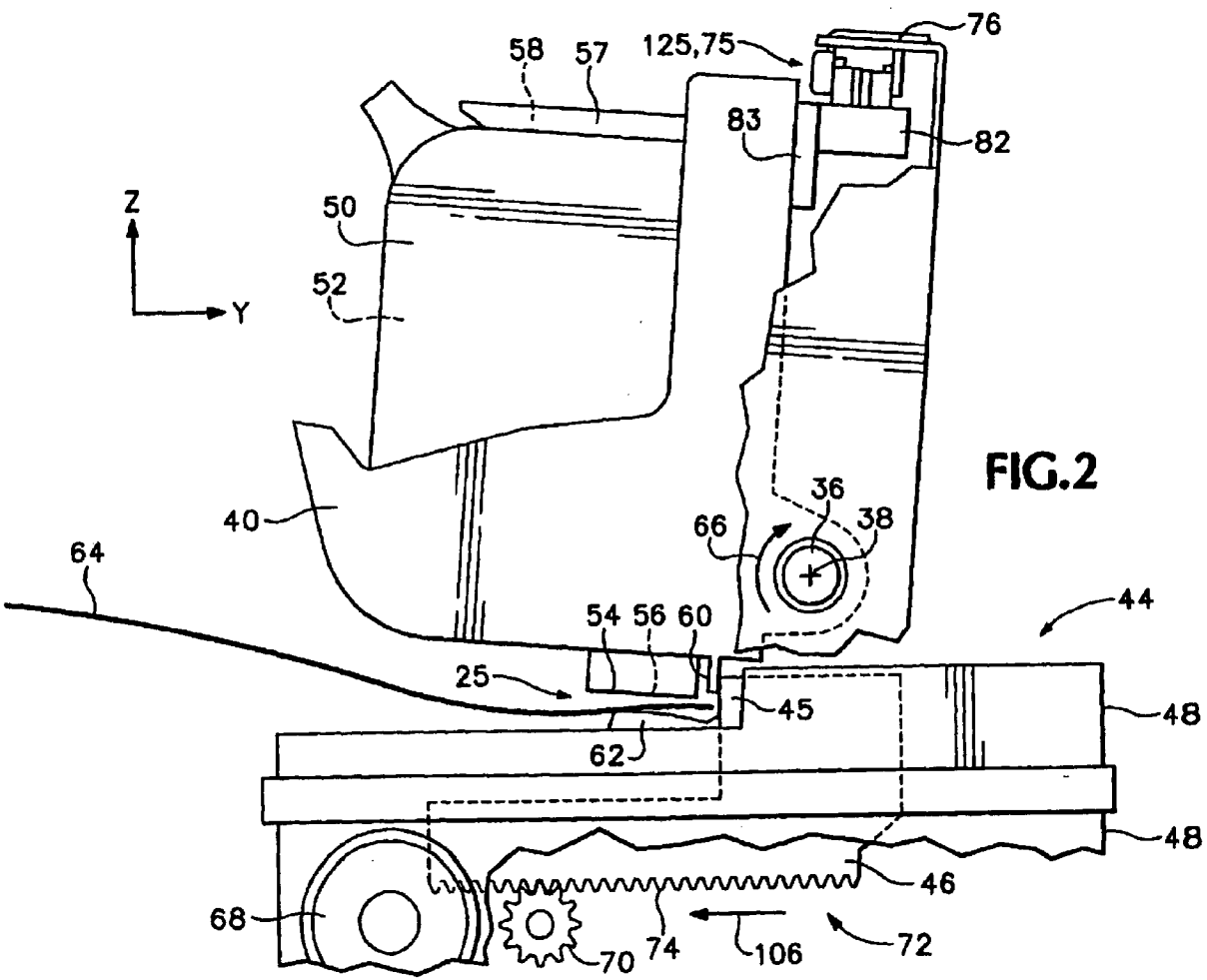
FIG. 2 is an enlarged, side elevational view of the automatic spacing system of FIG. 1.

FIG. 2 shows the operation of an illustrated subsystem, here the printhead carriage 40 which includes a carriage elevation adjustment member, such as a flange 60 extending downwardly from the lower surface of the carriage. The carriage 40 holds the pens 50, 52 so printheads 54, 56 are suspended at a desired elevation to establish a desired separation from a media support or platen portion 62 of the media handling system 26. When a sheet of media 64 enters the printzone 25, and rests upon the platen 62, a PPS spacing is established between the upper printing surface of the media 64 and the printheads 54, 56.

For consistency herein, to the extent possible, the term "separation" will be used to define the spacing between the media supporting surface of the platen 62 and the ink ejecting orifice plates of printheads 54, 56. In contrast, the term "spacing" will be used herein to refer to the PPS spacing between the print surface of a sheet of media 64 and the orifice plates of printheads 54, 56.

For media thicker than sheet 64 in FIG. 2, given the current separation between the printheads 54, 56 and the platen 62, the thicker media in printzone 25 decreases the PPS spacing, whereas media thinner than sheet 64 increases the PPS spacing from that shown in FIG. 2. The service station activation member 45 in the illustrated embodiment rotates the carriage 40 around guide rod 36 in the direction of curved arrow 66 to cause printheads 54, 56 move upwardly away from the platen 62. In other embodiments it may be preferred to rotate the platen 62 in response to motion of the service station activation member 45. Thus, carriage rotation is described herein by way of illustrating one preferred embodiment for automatically adjusting printhead to paper spacing to accommodate various thicknesses of media.

In the illustrated embodiment, the service station 44 includes a motor 68 which may be coupled by a conventional drive mechanism, such as a reduction gear assembly (omitted for clarity) to drive a pinion gear 70 of a rack and pinion gear assembly 72. The other component of the rack and pinion assembly 72 is a rack gear 74 which is preferably formed along a lower surface of the service station pallet 46. As mentioned above, the activation member 45 is moved by the pallet 46, through operation of motor 68 and the rack and pinion gear assembly 72 to be brought selectively into contact with the carriage elevation flange 60, with this contact serving to rotate the carriage 40 in the direction of arrow 66 increase the printhead to platen separation to accommodate thicker media. Preferably pallet 46 runs within guide rails or other alignment means formed by the carriage frame 48, for instance in a manner described in U.S. Pat. Nos. 5,980,018 or 6,132,026.

Figure 3:
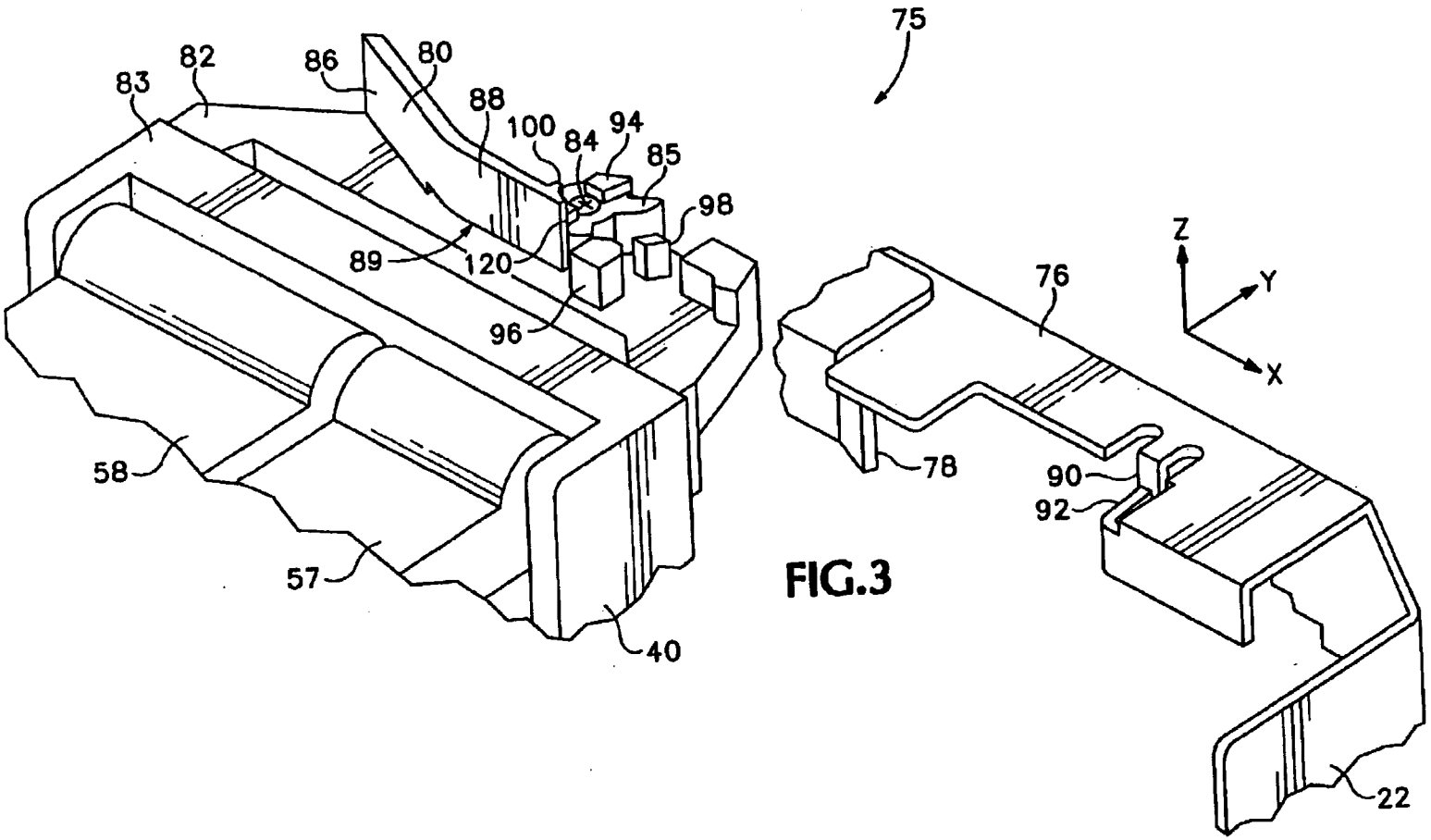
FIG. 3 is a fragmented, enlarged, perspective view of a first embodiment of a portion of the automatic spacing system of FIG. 1.

Now the motion of the carriage and printheads with respect to the platen is understood for changing the spacing between the printheads and the print surface of an incoming sheet of media 64, a first embodiment of a latching mechanism, here comprising a cam operated latching system 75, constructed in accordance with the present invention, is described. The cam operated latching system 75 holds the carriage 40 in either the raised or lowered position as the carriage travels along the printzone 25. FIG. 3 shows the printer chassis 22 defining in part a backbone portion 76 of the chassis. The backbone 76 defines therein a rail or track 78 along which a slider member 80 of the carriage 40 traverses when moving over the printzone 25. The slider member 80 projects upwardly from a cam support platform 82 which extends rearwardly from a rear wall portion 83 of the carriage 40. Note for clarity, the carriage latches 57 and 58 have been omitted from the view of FIG. 3. A pivot post 84 projects upwardly from the support platform 82 to pivotally support a cam member 85 adjacent the slider 80.

Before delving into operation of the cam 85 and slider 80, a few other components will be pointed out first with reference to FIG. 3. First, it should be noted that the slider 80 has a fixed portion 86 which is firmly attached to the support platform 82, and a flexible portion 88 which pivots about the Z-axis in response to rotation of the cam 85. In the illustrated embodiment, the flexible portion 88 of the slider 80 is formed by defining a slot 89, which extends between the flexible portion 88 and the support platform 82.

In the illustrated embodiment, the chassis backbone 76 is formed with two features which are used to rotate and activate the cam 85 as the carriage 40 brings cam 85 into contact with these features. The first feature is a cam actuator member 90, which in the illustrated embodiment is shown as a sheet metal tab projecting downwardly into the path of movement of the cam 85. The cam actuator 90 is used to elevate the carriage 40 to raise printheads 54, 56. The second feature is a cam reset member 92, which when brought into contact with cam 85 through operation of carriage 40, returns the carriage 40 to a lowered position. The lowering or reset cam actuator 92 operates in conjunction with a reset feature 94 projecting upwardly from the main body of the cam 85. To prevent rotation of the carriage 40 beyond a desired elevation during a printhead servicing routine (like wiping, capping or sealing), a carriage anti-rotation stop 96 projects upwardly from the support platform 82 to impact the backbone 76. Also projecting upwardly from the support platform 82 is a cam rotation stop 98 which prevents overtravel of the cam 85 during elevation. Other features of this system will be introduced as they become pertinent to an explanation of operation.

Figure 4:
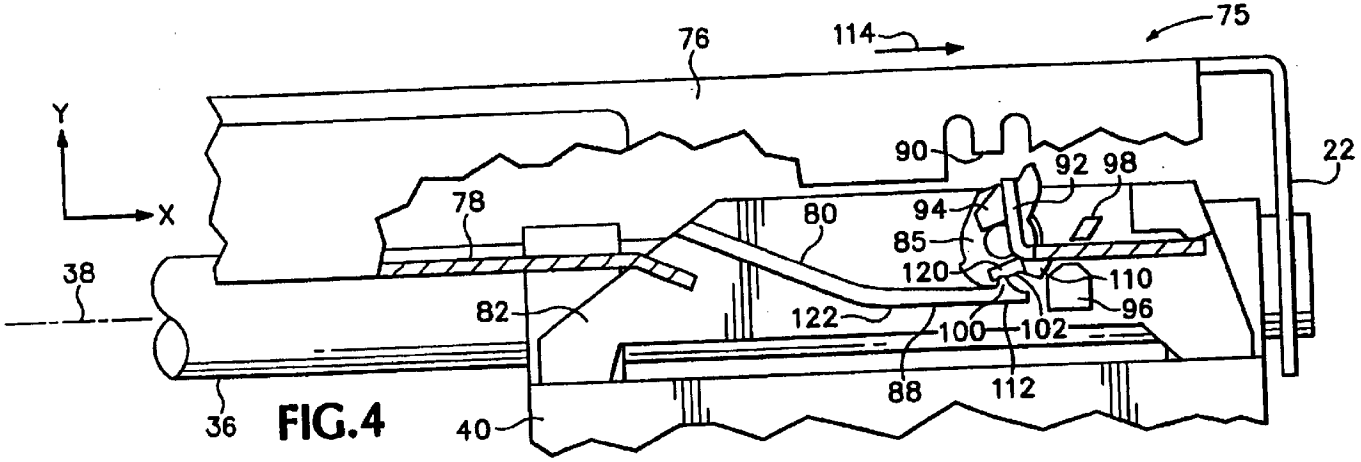
Figure 5:
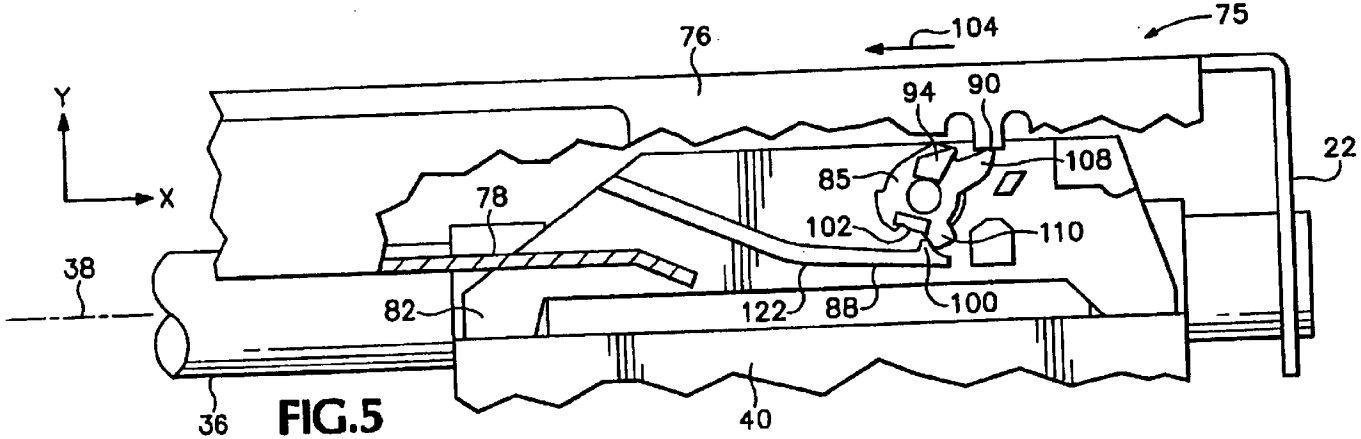
Figure 6:
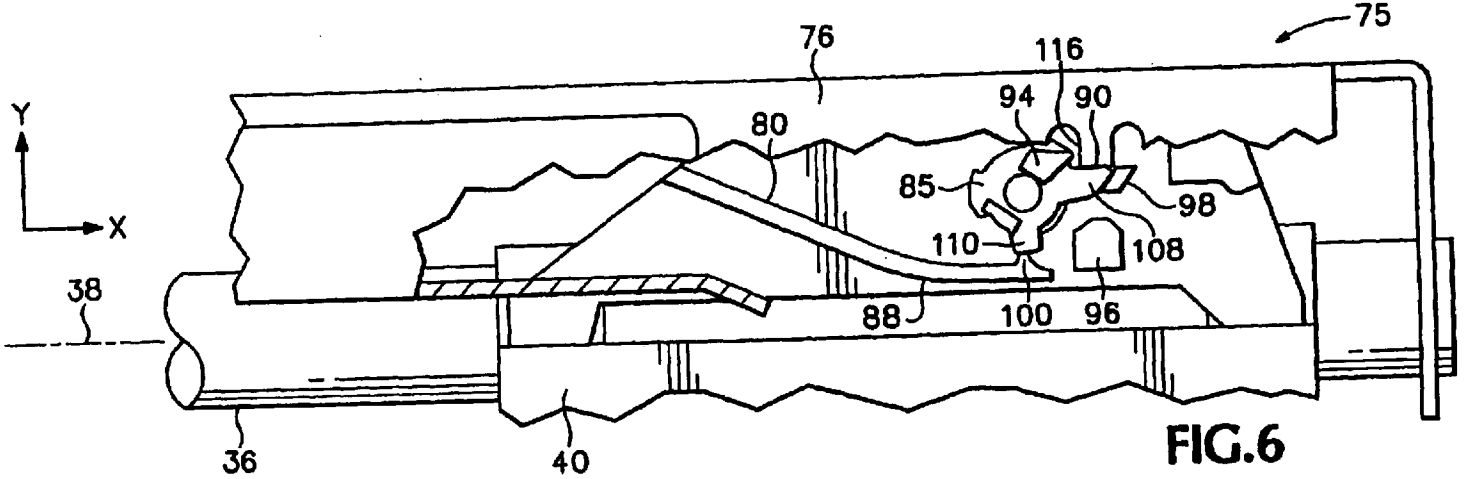

FIGS. 4–6 illustrate the latching operation of the cam style automatic pen-to-paper spacing adjustment system 75, which is shown in detail in FIG. 3. FIG. 4 illustrates the carriage 40 in a lowered position for printing on thin media, and actually shows the resetting operation where the transition is made from the elevated position to the lowered position. Rather than explain this transition in detail now, first the transition to the elevated position will be discussed after which we will return to describe the lowering transition. The flexible slider 80 includes a cam follower or finger portion 100 which is shown riding on a lowered land portion or surface 102 of cam 85 in FIG. 4.

In transitioning from the position of FIG. 4 to the position of FIG. 5, the carriage 40 is first moved in the direction of arrow 104 to the axial position shown in FIG. 5. Returning briefly to FIG. 2, when the carriage is at the position of FIG. 5, the service station motor 68 moves the pallet 46 in the direction of arrow 106. As described above, the activation member 45 on pallet 46 engages the flange 60 and causes the carriage 40 to rotate in the direction of arrow 66. This upward rotation of the carriage 40 in the direction of arrow 66 causes an elevating cam surface 108 of cam 85 to engage the cam actuator 90, which projects downwardly from the chassis backbone 76. As shown in FIG. 5, the slider finger 100 has now moved off of the lowered land portion 102 of cam 85. In transitioning from the position of FIG. 5 to that of FIG. 6, the service station motor 68 continues to drive the pallet activation member 45 into contact with flange 60 to further rotate the carriage 40 in the direction of arrow 66, until the cam 85 has rotated into the elevated carriage position of FIG. 6. In FIG. 6 we see the slider finger 100 now rests on an elevated cam surface 110 of cam 85. Further rotation of the cam 85 in a clockwise direction is prevented by the elevating cam portion 108 of cam 85 coming into contact with the cam rotation stop 98 extending upwardly from the support platform 82.

Figure 7:
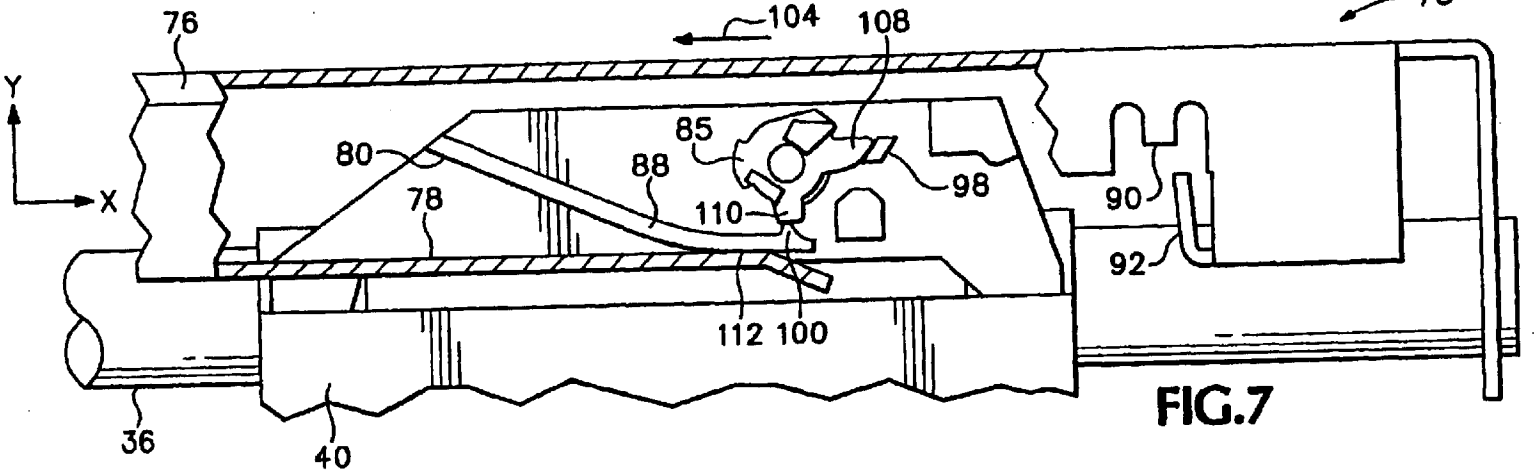

From the position in FIG. 6, the service station pallet 46 retreats in the direction opposite arrow 106 (FIG. 2) to lower the carriage until the arm 80 contacts the rail 78. After this lowering, the carriage 40 is then moved in the direction of arrow 104 toward the printzone 25 to conduct a print job. With the cam 85 held in position by contact of the elevating cam surface 108 with the cam rotation stop 98, and finger 100 of the slider riding along the elevated cam surface 110 of cam 85, the printheads are ready to print on thick media, such as envelopes. In the illustrated embodiment, the degree of carriage rotation from the lowered position of FIG. 4 to the elevated position of FIG. 7 is on the order of 1.6°, although it is apparent that other degrees of rotation may be employed for different implementations of the system. FIG. 7 shows the carriage 40 moving further in the direction of arrow 104 toward the printzone 25, with the slider flexible portion 88 having a slide surface 112 which glides along the inside of the rail 78.

As promised above, the resetting operation to transition the carriage 40 from the elevated printhead position to the lowered position will be explained now as we transition from the position of FIG. 7 to that of FIG. 4. Following the printing operation of FIG. 7, as the carriage 40 is returned in the direction of arrow 104 toward the position of FIG. 4, the resetting cam feature 94 of cam 85 begins contacting the resetting cam actuator 92 projecting from the chassis backbone 76, causing the cam 85 to begin rotation in a counter-clockwise direction. This counter-clockwise rotation of cam 85 causes the slider finger 100 to transition off of the elevated cam surface 110 and back down toward the lowered cam surface 102. At this point it may be noted that the cam 85 has an elevated feature 120 which projects upwardly from the main body of cam 85, as shown in FIG. 3, which provides more support for the arm 80, but otherwise currently has no special carriage adjustment purpose.

Thus, in the position of FIG. 4, the flexible portion 88 of slider 80 is in a rest position, whereas in the positions of FIGS. 6 and 7, this slider flexible portion 88 is in a stressed position. In the rest or default position of FIG. 4, the flexible portion 88 of slider 80 is positioned so not only surface 112, but also surface 122 of slider 80 glides along track 78 during printing, leaving the carriage 40 in a lowered position for printing on thin media. When the slider 80 engages the rail 78, the printhead-to-media spacing is fixed at the level selected through rotation of cam 85 as described above. Allowing the slider 80 and rail 78 to disengage as shown in FIG. 4 places the printheads in a lowered position, which also facilitates servicing of the printheads 54, 56. Furthermore, in the servicing position of FIG. 4, the pallet activation member 45 moves past the inboard side of the carriage flange 60, allowing free pallet motion in the positive and negative Y directions to facilitate printhead servicing by the various servicing components carried by pallet 46. It is apparent that through slight modification of the cam 85, one or more intermediate elevations may also be achieved, as well as by modifying or adding additional cam actuators to the backbone 76.

FIGS. 8–15 illustrate a second alternate embodiment of a carriage elevation locking mechanism 125, constructed in accordance with the present invention which may be used to hold the carriage 40 in either an elevated position or a lowered position. While two examples of locking mechanisms 75, 125 are illustrated herein, it is apparent that these locking mechanisms may be implemented in a variety of different ways using structural and functional equivalents as well as other means beyond those shown here for mechanisms 75 and 125, while still falling within the scope and spirit of the claims below. Moreover, in one of the broader aspects of this system, we have a movable member of the service station 44, here shown as the activation member 45 projecting upwardly from the movable pallet 46, which operates on another subsystem of the printing mechanism 20, to change that subsystem from one state to another state. Indeed, while subsystem two states are described here, it is apparent that any particular subsystem may be transitioned between three or more states, depending upon the particular implementation employed.

Additionally, while a translational service station is illustrated herein, other service stations having movable members may be employed to activate the selected subsystem. For instance, rotary service stations such as shown in U.S. Pat. Nos. 5,614,930 and 5,896,145, as well as service stations having both translational and rotational characteristics, such as the service station which is commercially available in Hewlett-Packard Company's Professional Series 2000C color inkjet printer may also be used. Moreover, rather than operating on the carriage 40, the service station activation member may be constructed to operate on the platen 62 to vary the separation between the platen 62 and printheads 54, 56. Additionally, other functionalities may be addressed through operation of the service station activation member, beyond addressing the problem of printhead-to-media spacing. For instance, the service station 44 may be used to operate on other portions of the media handling system, for instance to assist in picking media from the input tray 30.

Figure 8:
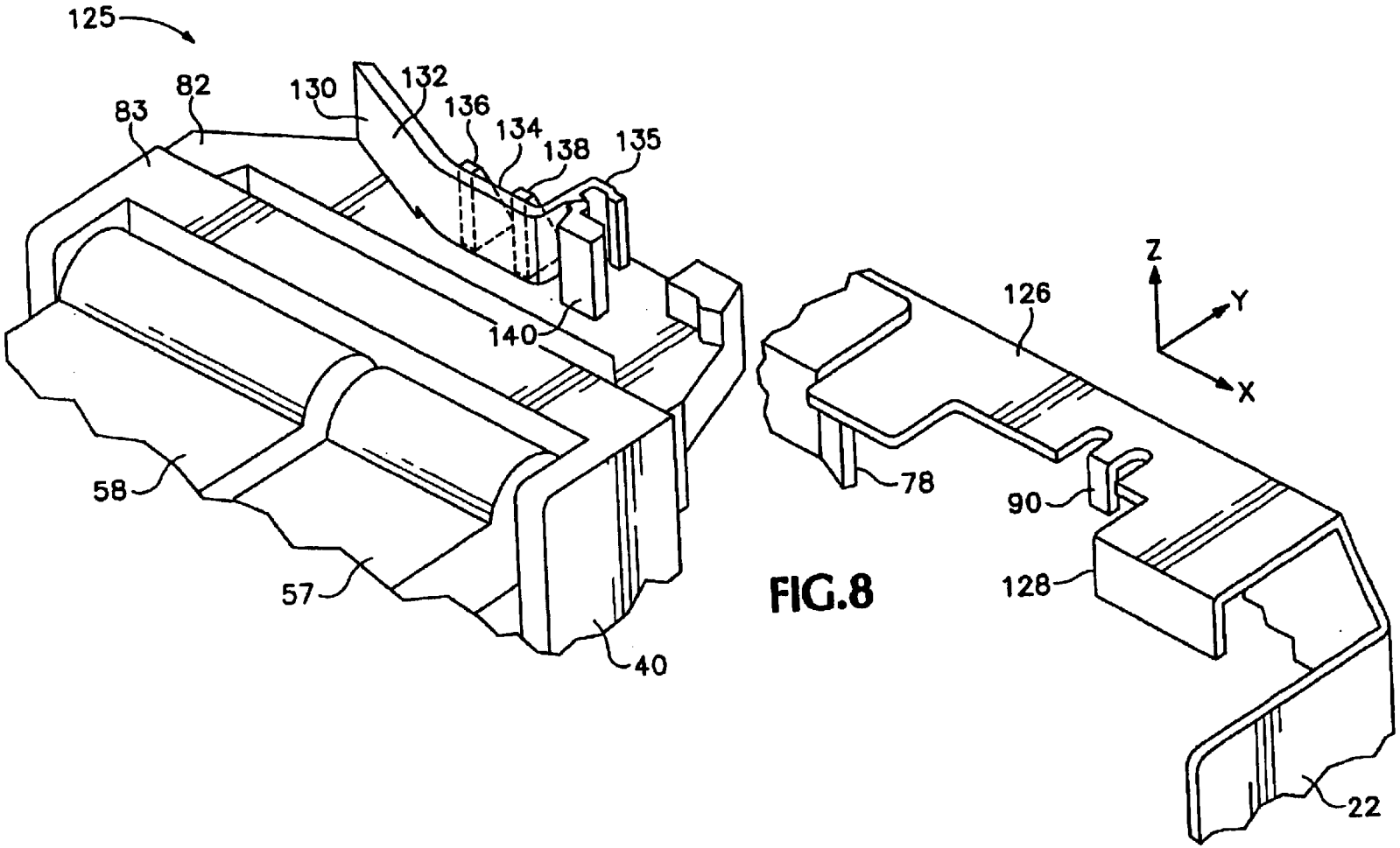
FIG. 8 is an enlarged, fragmented, perspective view of a second embodiment of an automatic pen-to-paper spacing system which may be used in the printer of FIG. 1.

Returning now to the detailed view of FIG. 8, the lever type locking mechanism 125 is shown set in a lowered carriage position. Here we see extending from the chassis 22 a slightly modified backbone 126, which includes actuator 90 as described above and a modified reset actuator 128, which lacks the L-shaped portion extending in the direction of the Y-axis (FIG. 3). The backbone 76 also includes a guide rail 78 constructed as described above. Projecting upwardly from the carriage support platform 82 is a locking lever type slider arm 130. The slider 130 has a stationary portion 132 attached to platform 82, and a flexible portion 134 which terminates in a locking latch portion 135. Projecting upwardly from the support platform 82 are a pair of arm stops 136 and 138, which serve to hold the flexible portion 134 of slider 130 at the lowered carriage position. Also projecting upwardly from the support platform 82 is a locking head 140 which serves to hold latch 135 in selected positions. Various features of the locking latch 135 and head 140, will be introduced and described further below with respect to a description of the operation of the lever locking mechanism 125 as shown in FIGS. 9–15.

Figure 9:
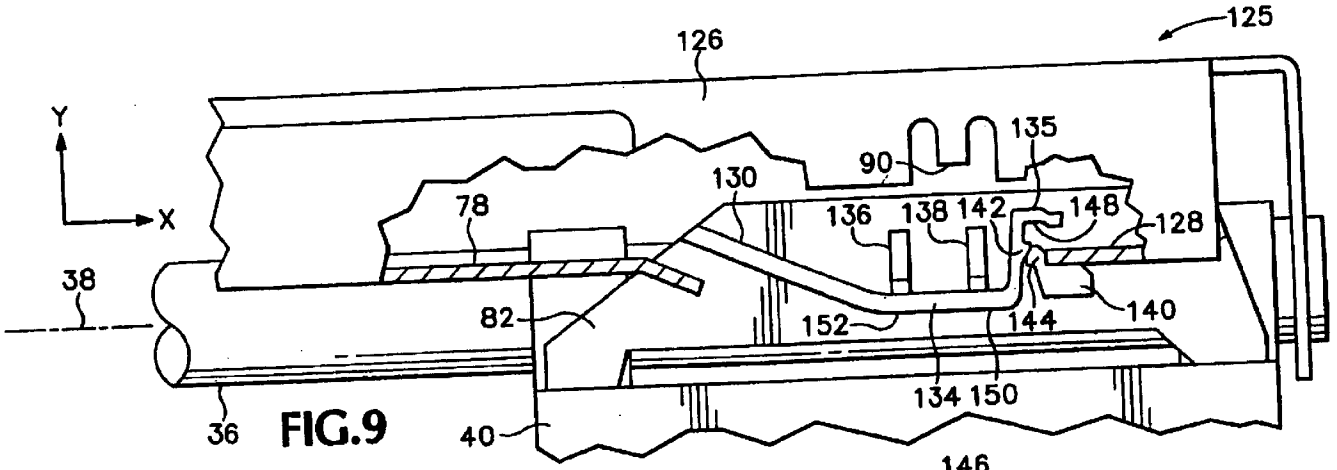

FIG. 9 shows the carriage 40 in a lowered position for printing on thin media. Here, we see the flexible portion 134 of slider 130 is riding against the stops 136 and 138. In this position, the locking latch 135 has a shoulder 142 which is resting against a nose portion 144 of the locking head 140. Indeed, as described above with respect to FIG. 4, FIG. 9 also shows a resetting operation following transition from the elevated position to the lowered carriage position, which we will return to following a description of FIGS. 10–12.

Figure 10:
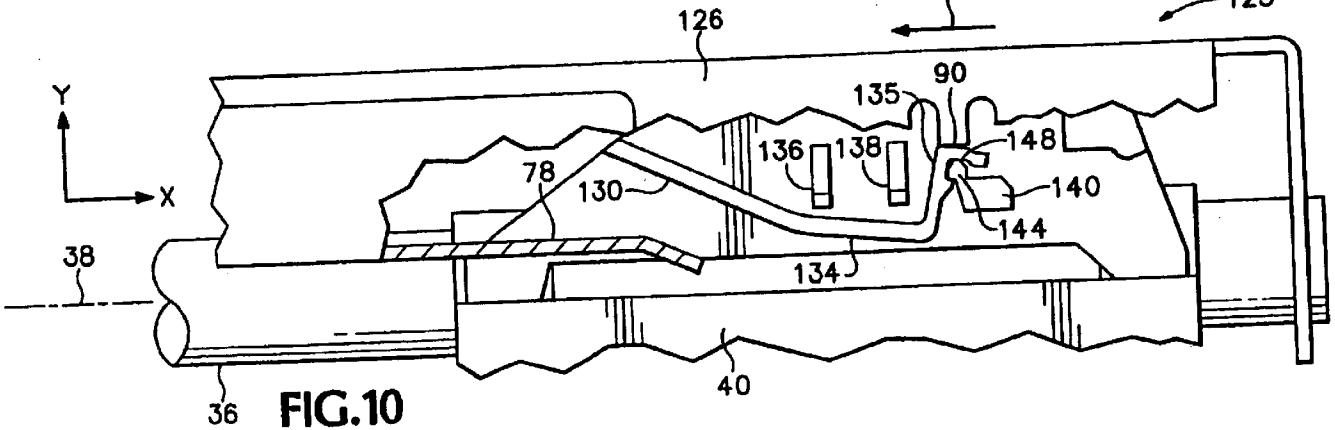

In transitioning from the position of FIG. 9 to FIG. 10, the carriage 40 is moved in the direction of arrow 146 until the locking latch 135 and nose portion 144 of head 140 are opposite the backbone actuator member 90. Returning briefly to FIG. 2, once the carriage is in the position shown in FIG. 10, the service station motor 68 operates to drive the activation member 45 into contact with the carriage flange 60, causing the carriage to rotate in the direction of arrow 66 until the locking latch 135 engages the backbone actuator member 90. Further rotation of the carriage through motion of the pallet actuator member 45 in the direction of arrow 66, causes the lever 134 to flex, allowing the shoulder 142 to disengage and slip off of the nose portion 144 of head 140 until reaching the position shown in FIG. 10. Here we see the nose portion 144 of head 140 has been captured within a latch pocket 148 defined by latch 135. The engagement of the nose portion 144 of locking head 140 within the pocket portion 148 of the latch 135 serves to secure the slider 130 in the elevated position during printing. At this point, the pallet 46 retreats in a direction opposite arrow 106 (FIG. 2), allowing the activation member 45 to disengage from the carriage flange 60. After this disengagement, the carriage pivots downwardly, in a direction opposite arrow 66 (FIG. 2).

Figure 11:
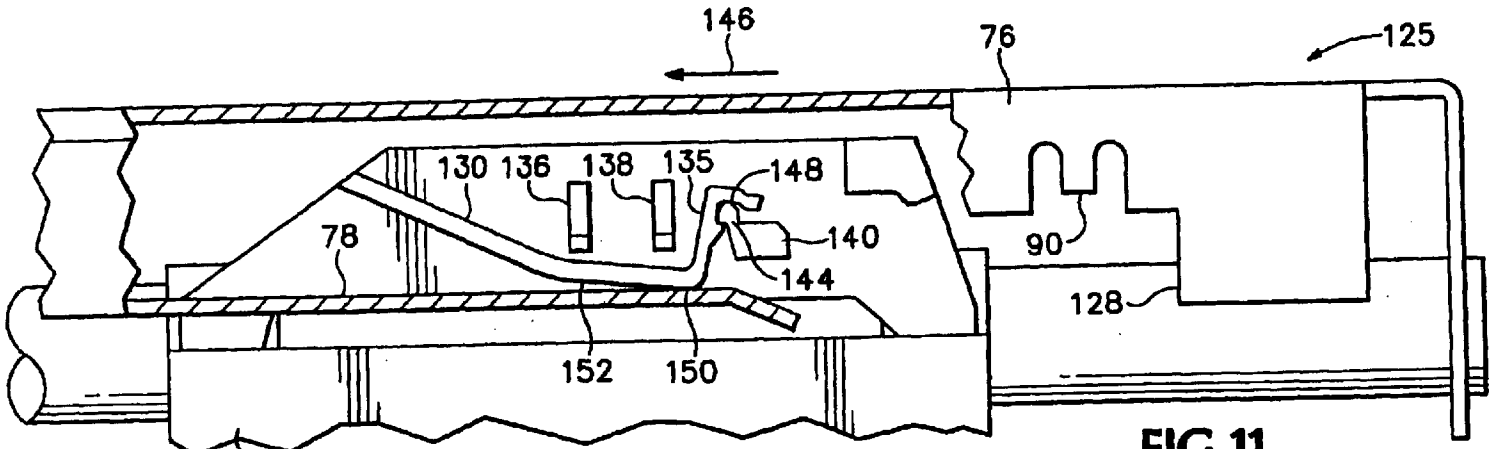
Figure 12:
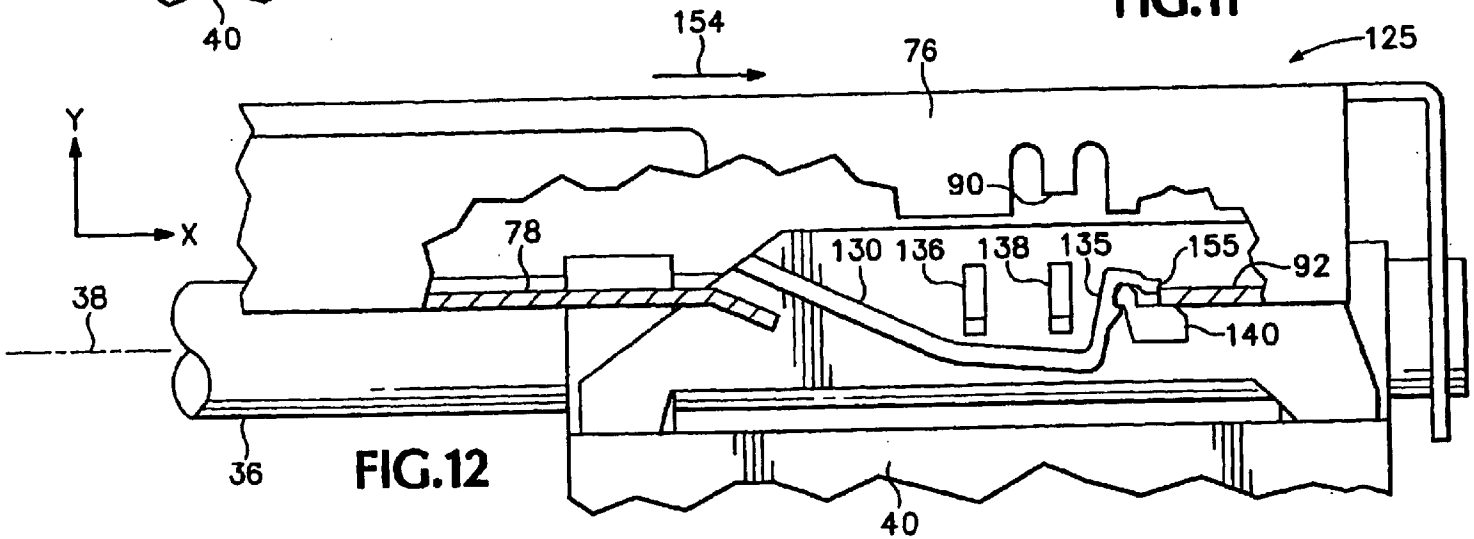

FIG. 11 shows the carriage 40 moving further in the direction of arrow 146 toward the printzone 25 to conduct a print job. In FIG. 11 we see a small slider contact surface 150, riding along the rail 78 when the carriage is in the elevated position. In comparison, in FIG. 9 where the carriage is in the lowered position, not only surface 150, but also surface 152 glides along the rail 78 during a print job. Following printing, when it is desired to return the carriage 40 to the lowered position, the carriage is moved in the direction of arrow 154 to the position shown in FIG. 12. Here, we see a reset end surface 155 of the locking latch 135 contacting the resetting actuator 92 of backbone 76. Further motion of the carriage in the direction of arrow 154 allows the resetting actuator 92 to push the latch portion 135, causing it to flex and disengage nose 144 from pocket 148. When the nose 144 comes out of pocket 148, the weight of the carriage 40 causes the carriage to drop downwardly, rotating in the direction opposite arrow 66 (FIG. 2) until the stops 136 and 138 engage the slider arm 130 as shown in FIG. 9.

Figure 13:
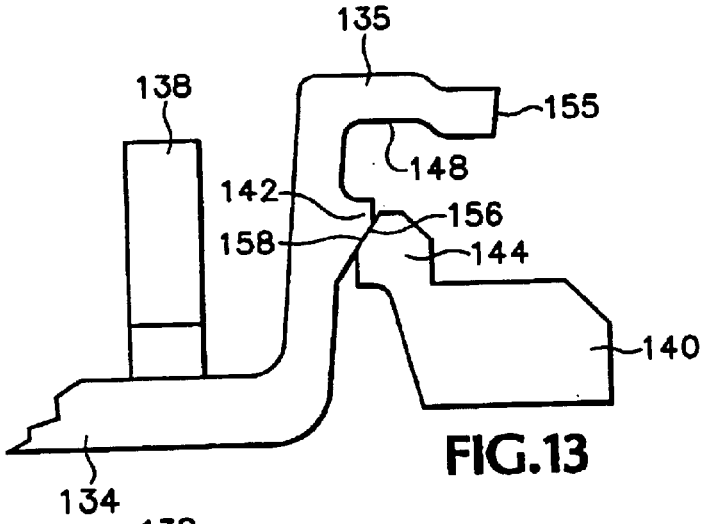
Figure 14:
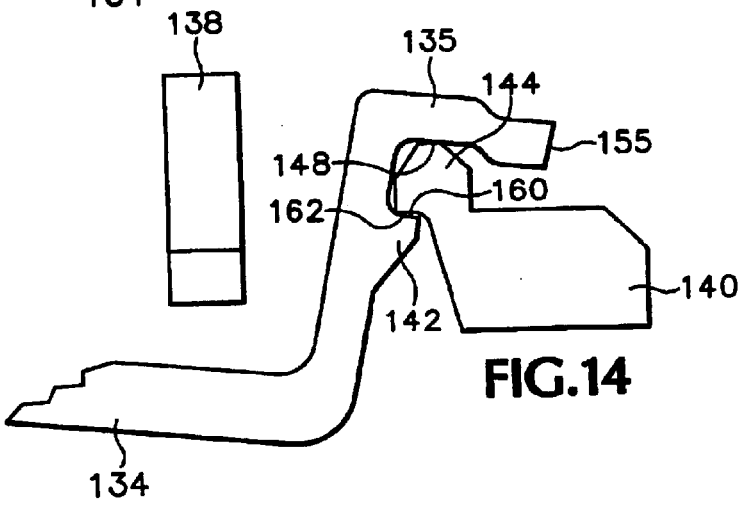
Figure 15:
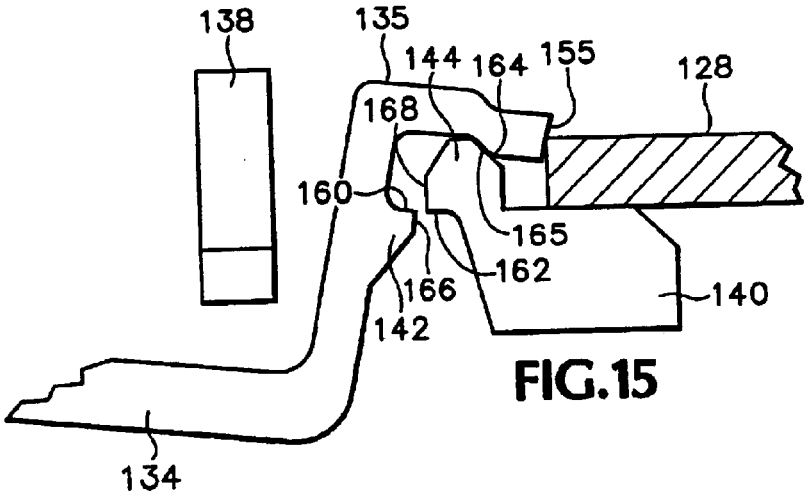

A more detailed operation of the latch 135 and head 140 is shown with respect to FIGS. 13–15. FIG. 13 shows the lowered carriage position, where the flexible portion 134 of slider 130 is pushed back to contact the stops, with only stop 138 being shown in FIG. 13. In this lowered position, the shoulder 142 has a lower ramped surface 156 which is in contact with a ramped surface 158 of the nose portion 144 of head 140. FIG. 14 shows the carriage in the elevated position corresponding to FIGS. 10 and 11, where the nose portion 144 of head 140 is received within pocket 148. In this position, we see shoulder 142 having an upper surface 160, which is engaged by a lower surface 162 of the nose 144, with this engagement serving to hold the head 140 within pocket 148 during printing.

FIG. 15 shows the resetting operation, where the carriage is transitioned from the elevated position back to the lowered position. Here we see the nose 144 has a ramped surface 164 which contacts a ramped surface 165 of the latch 135. As the lower portion 162 of nose 144 disengages from contact with the upper portion 160 of shoulder 142, the weight of the carriage 40 causes the carriage to rotate in the direction opposite arrow 66 (FIG. 2). During this disengagement operation, the surfaces 164 and 165 slide apart and off one another, allowing the slider flexible portion 134 to move into contact with the stops 136 and 138, returning the carriage to the lowered position with the latch 135 and head 140 in the positions shown in FIG. 13. Indeed, FIG. 15 is somewhat of an exaggerated drawing shown for the purposes of illustration, because immediately upon disengagement of surfaces 160 and 162, rotation of the carriage under the force of gravity begins causing a vertical surface 166 of shoulder 142 to slide by a vertical surface 168 of nose 144.

In conclusion, the broad concept of a service station with a movable member interacting with a printer subsystem, which is changeable between a first state and a second state, has been illustrated in detail with respect to two preferred embodiments comprising latch mechanisms 75 and 125 for varying the PPS printhead-to-media spacing. However, as discussed above other subsystems of the printer 20 may be designed to be transitioned between two or more states through motion of a movable member on the printhead service station. In the transitioning between states, gravity was used to assist in making one transition rather than service station movement to return the carriage to the initial state. Similarly, centrifugal forces, or momentum may be employed in some implementations to assist in one of the transitions. Furthermore, while the illustrated carriage locking mechanisms 75 and 125 have been shown in terms of a locking cam and a locking lever, it is apparent that the locking mechanism chosen to secure a particular subsystem in one state or another, may be accomplished through a variety of different mechanisms, as well as through the use of electronic means, such as by using a locking solenoid. Such electrical or electromechanical solutions are also within the scope of the concepts introduced herein. Indeed, magnets or electromagnets may also be used to secure a printer subsystem in one state or another. For instance, if using an electromagnetic latching mechanism, in the illustrated embodiment accomplishing carriage rotation, the service station movable activation member 45 may be used to rotate the carriage from the lowered position to an elevated position where a ferrite or iron portion of the carriage encounters an electromagnet mounted along the support platform 82, whereupon the electromagnet is engaged to hold the carriage in the elevated position. To accomplish lowering of the carriage under the force of gravity, the electromagnet is simply deactivated, causing the ferrite portion of the carriage to move away from the electromagnet to lower the carriage. Thus, it is apparent that the illustrated embodiments herein for securing a subsystem in one state or another may take on a variety of structurally equivalent forms beyond the specific preferred embodiments illustrated herein without departing from the broad concepts of the claims below.

We claim:

1. A method of establishing positions of a carriage about a rod to which the carriage is rotatably mounted and along which rod the carriage is slidable while guided for such sliding movement by a slider member on the carriage, comprising:

mounting a movable latch member to the carriage;

moving the carriage to a selected latching location on the rod near a first chassis part;

rotating the carriage about the rod with the carriage remaining at the latching location whereby the latch member is mounted to the carriage at a position such that the carriage rotation causes the latch member to engage the first chassis part and secure the slider member in a latched position for establishing a first rotational position of the carriage when the slider member guides the sliding movement of the carriage.

2. The method of claim 1, including releasing the slider member from the latched position and into an unlatched position thereby to establish a second rotational position of the carriage when the slider member is guiding sliding movement of the carriage.

3. The method of claim 2 wherein releasing includes moving the latch member into engagement with a second chassis part thereby to move the latch member relative to the carriage so that the slider member moves into the unlatched position.

4. The method of claim 3 moving the latch member into engagement with the second chassis part permits the carriage to move into the second rotational position.

5. The method of claim 1 wherein mounting includes mounting to the carriage a bendable lever as the movable latch member.

6. The method of claim 5 including mounting a head member on the carriage adjacent to the lever and shaped to engage the lever and lock the lever in a latched position.

7. The method of claim 6 including shaping the lever to have a pocket for capturing the head member therein when the head member engages the lever.

8. A method of securing a carriage in a first rotational position about an elongated support rod, comprising the steps of:

mounting a pusher member to a chassis relative to which the carriage moves;

moving the carriage to a predetermined axial position along the length of the support rod;

rotating the carriage about a support rod using the pusher member while the carriage is at the axial position;

mounting to the carriage a latch mechanism that is oriented for engagement with the chassis and for movement into a latched position wherein the carriage is secured in the first rotational position when the latch mechanism is in the latched position; and locating the latch mechanism so that the movement of the latch mechanism occurs as a result of the carriage rotation using the pusher member.

9. The method of claim 8 mounting the latch mechanism includes mounting a bendable lever to the carriage.

10. An assembly for establishing the positions of a printer carriage about a rod to which the carriage is rotatably mounted and along which rod the carriage is slidable; comprising:

a bendable slider member carried by the carriage and shaped for guiding sliding movement of the carriage along the rod;

latch means for securing the slider member in a latched position that establishes a first rotational position of the carriage as the slider member guides the sliding movement of the carriage;

carriage rotation means for moving the carriage to a selected latching location on the rod for rotating the carriage about the rod with the carriage remaining at the latching location so tat the carriage rotation causes the latch means to engage a first printer part and secure the slider member in the lathed position.

11. The assembly of claim 10 wherein the carriage rotation means includes a pusher for rotating the carriage about the rod.

12. The assembly of claim 10 wherein the latch means includes a cam that is rotatably mounted on the carriage in contact with the slider member and that is rotatable into a set position that secures the slider member in the latched position.

13. The assembly of claim 12 wherein the cam includes a reset feature oriented to be engageable with a second part of the printer so that such engagement with the second printer part moves the cam out of the set position so that the slider member is not secured in the latched position.

14. The assembly of claim 10 wherein the slider member includes a lever portion, the lever portion having a reset feature oriented to be engageable with a second part of the printer so that such engagement with the second printer part moves the slider member out of the set position so that the slider member is not secured in the latched position.

15. The assembly of claim 14 wherein the lever and slider member are integrally formed.

16. The assembly of claim 14 further comprising a head member mounted on the carriage adjacent to the lever portion and shaped to engage the lever portion to lock the slider member in the latched position.

17. The assembly of claim 16 including a pocket formed in the lever portion for capturing the head member therein when the bead member engages the lever portion of the slider member.

18. The assembly of claim 10 wherein the first printer part is a rigid part having a stationary actuator surface for engaging the latch means.

19. The assembly of claim 18 wherein the second printer part is a rigid part having a stationary reset surface for engaging the latch means for moving the cam out of the set position.

20. The assembly of claim 19 wherein the actuator surface and the reset surface are in planes substantially perpendicular to one another.

* * * * *

UNITED STATES PATENT AND TRADEMARK OFFICE

CERTIFICATE OF CORRECTION

PATENT NO. : 6,840,598 B2
DATED : January 11, 2005
INVENTOR(S) : Michael A. Fairchild et al.

It is certified that error appears in the above-identified patent and that said Letters Patent is hereby corrected as shown below:

Column 13,
Line 24, after "3" insert -- wherein --.

Column 14,
Line 12, delete "tat" and insert therefor -- that --.
Line 45, delete "bead" and insert therefor -- head --.

Signed and Sealed this

Sixth Day of September, 2005

JON W. DUDAS
*Director of the United States Patent and Trademark Office*